US006079520A

United States Patent [19]

Black et al.

[11] Patent Number: 6,079,520

[45] **Date of Patent: *Jun. 27, 2000**

[54] METHOD OF RETRO-FITTING ELEVATORS TO EXISTING BUILDINGS

[75] Inventors: Richard W. Black, Dix; Kevin L. Phillips, Richview; Stanley Holtkamp, Centralia, all of Ill.

[73] Assignee: Infinite Access Corporation, Mt. Vernon, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/856,041

[22] Filed: May 14, 1997

Related U.S. Application Data

[63] Continuation of application No. 08/418,839, Apr. 7, 1995, abandoned.

[51] Int. Cl.[7] ..... B66B 9/00

[52] U.S. Cl. ..... 187/239; 187/240; 187/241

[58] Field of Search ..... 187/239, 240, 187/244, 414, 242, 241

[56] References Cited

U.S. PATENT DOCUMENTS

| | | | |
|---|---|---|---|
| 1,867,568 | 7/1932 | Hirshfeld | 187/414 X |
| 1,936,195 | 11/1933 | Honig | 187/241 |
| 2,763,339 | 9/1956 | North | 187/406 |
| 3,820,632 | 6/1974 | Jines | 187/240 |
| 4,557,353 | 12/1985 | Pichon | 187/239 |
| 4,875,547 | 10/1989 | Hanthorn | 187/241 |

FOREIGN PATENT DOCUMENTS

| | | | |
|---|---|---|---|
| 1391768 | 2/1965 | France | 187/244 X |
| 1252477 | 10/1989 | Japan | 187/239 X |
| 9317950 | 9/1993 | WIPO | 187/239 X |

OTHER PUBLICATIONS

Reynolds Televator brochure, Apr. 1984.

*Primary Examiner*—Christopher P. Ellis
*Assistant Examiner*—Khoi H. Tran
*Attorney, Agent, or Firm*—Armstrong Teasdale LLP

[57] ABSTRACT

A method of retrofitting an elevator to an existing multistory building includes providing a preassembled elevator unit comprising an enclosure containing an elevator car and a drive mechanism for moving the car within the enclosure; forming a plurality of vertically aligned elevator access openings though the exterior of the building; positioning the preassembled elevator unit against the exterior of the building, in alignment with the plurality of vertically aligned elevator access openings; and securing the preassembled elevator unit against the exterior of the building, in alignment with the plurality of vertically aligned elevator access openings. The preassembled elevator unit preferably includes a self-supporting elevator shaftway enclosed on the sides and back, and having at least one access opening in the front of the shaftway; an elevator car mounted in the elevator shaftway for movement therein; and a driver inside the shaftway for moving the elevator car in the shaftway.

6 Claims, 10 Drawing Sheets

METHOD OF RETRO-FITTING ELEVATORS TO EXISTING BUILDINGS

This application is a continuation of application Ser. No. 08/418,839, filed Apr. 7, 1995, now abandoned.

BACKGROUND OF THE INVENTION

This invention relates to a method of retro-fitting an elevator to an existing multi-level building, and to a preassembled elevator unit adapted for retro-fitting an elevator to an existing building.

Society as a whole is becoming more conscious of providing persons with disabilities with easy access to public and private buildings, and buildings designed today typically include wide doors, access ramps, and elevators to accommodate persons with disabilities. However, buildings designed and built more than a few years ago typically do not have these features, and are virtually inaccessible to many persons with disabilities. It can be very expensive to retro-fit these existing buildings to make them accessible to persons with disabilities. While ramps may provide access to a single story building, it is particularly difficult to provide disabled persons with access to multistory buildings. Installing an elevator in such buildings can be a problem because there is insufficient interior space, because it is extremely difficult and expensive to construct an appropriate shaft inside the building and assemble the elevator on site, and because the retro-fitting attempts can impair historically significant buildings. However, with the passage of the Americans with Disabilities Act, making buildings accessible is no longer just desirable, but in many cases mandated by law.

SUMMARY OF THE INVENTION

The present invention relates to a method of retro-fitting an elevator to an existing multi-level building, and to a preassembled elevator unit adapted for retro-fitting elevator service to an existing building. The present invention not only can provides access from ground level to an elevated single floor building, but can provide access among the floors in a multistory building.

Generally, the method of retro-fitting an elevator to an existing multilevel building according to the present invention comprises providing a preassembled elevator unit which includes an enclosure containing an elevator car and a drive mechanism for moving the car within the enclosure. An access opening is formed through the exterior of the building. The preassembled elevator unit is positioned against the exterior of the building, in alignment with the at least one access opening formed through the exterior. The preassembled elevator unit is then secured in position.

The preassembled elevator unit employed in the method of this invention generally comprises a self-supporting elevator shaftway enclosed on the sides and back, and having at least one access opening in the front of the shaftway. There is an elevator car mounted in the elevator shaftway for movement therein. There is also a driver inside the shaftway for moving the elevator car in the shaftway. There may optionally be access openings in the back of the shaftway as well. The access openings in the shaftway preferably include doors.

Because the preassembled elevator unit can be preassembled in a factory under controlled conditions, it can be manufactured much less expensively than a custom elevator assembled at the site.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
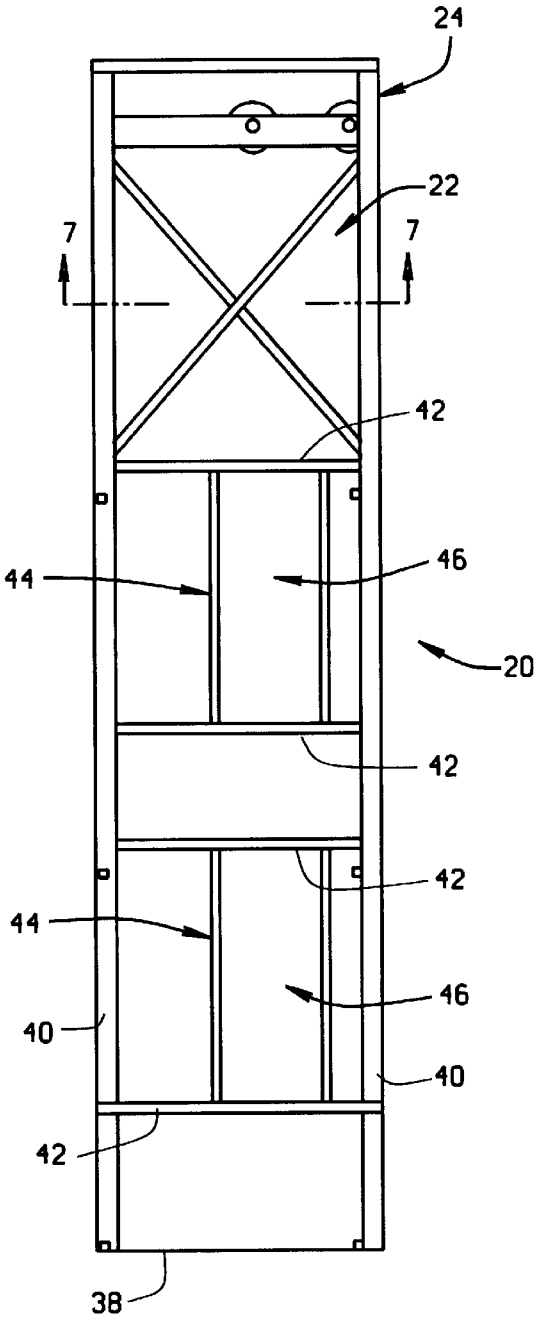
FIG. 1 is a front elevation of a preassembled elevator unit constructed according to the principles of this invention with the skin removed to reveal details of construction.
Figure 7:
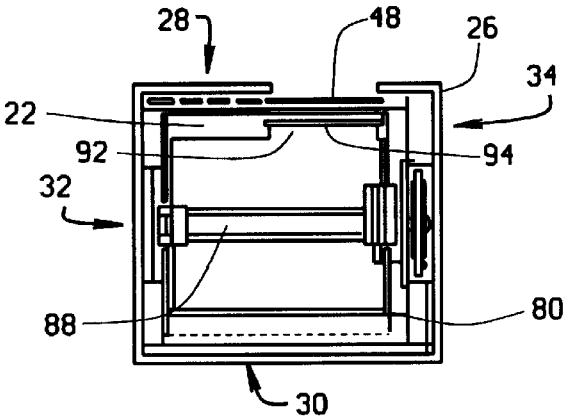
FIG. 7 is a vertical cross-sectional view of the preassembled elevator unit taken along the plane of line 7—7 in FIG. 1 with the skin in place.

A preassembled elevator unit constructed according to the principles of this invention is indicated generally as 20 in FIG. 1. The elevator unit 20 comprises a hoistway 22 having a generally rectangular horizontal cross-section that is constructed to be self-supporting with a frame 24 covered by a skin (shown in FIG. 7). The hoistway 22 has a front 28, shown in FIG. 1, which is adapted to be mounted against a building. The hoistway 22 also has a back 30, shown in FIG. 2, and left and right sides 32 and 34, the right side being shown in FIG. 3. The top of the hoistway 22 has a roof (not shown), protecting the interior of the hoistway from the weather. The bottom of the hoistway 22 has a floor 38.

The frame 24 comprises vertical members 40 at each corner of the hoistway 22. As shown in FIG. 1, at the front 28 of the hoistway 22, the frame 24 comprises a plurality of horizontal cross-members 42 extending between the vertical members 40 at the left and right sides. Door frames 44 are mounted between adjacent horizontal cross-members 42. The door frames 44 define access openings 46 in the front 28 of the hoistway 22. The access openings 46 are vertically spaced apart corresponding to the spacings between the floors of the building on which the unit 20 will be installed. Each of the access openings 46 is closed with a sliding door 48, or pair of sliding doors. (See FIG. 7) As shown in FIG. 1, there are two access openings 46 to permit travel between two floors in the building, however, there could be more or fewer access openings 46. For example, the unit 20 could have just one access opening in the front if the unit is intended to provide access to a single floor building from an exterior level that is either higher or lower than the building floor. The unit 20 could also have more than two access openings 46 in the front if the unit is to be used in a building with more than two floors. The only limit on number of access openings is the limitations on being able to transport and install the unit. As shown in FIG. 1, there are diagonal cross-members 50 between the vertical members 40, to strengthen and rigidify frame 24.

Figure 2:
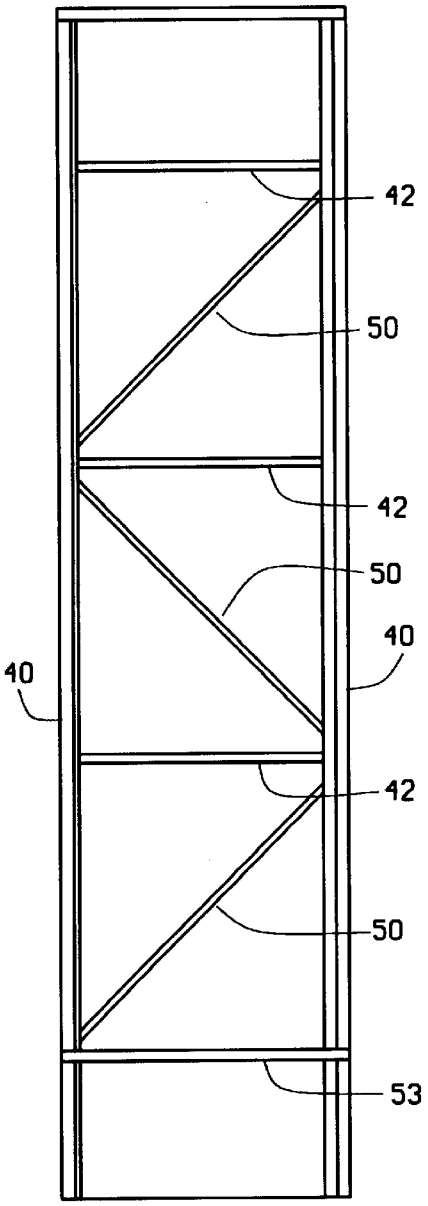
FIG. 2 is a rear elevation view of the preassembled elevator unit, with the skin removed to reveal details of construction.

As shown in FIG. 2, at the back 30 of the hoistway 22, the frame 24 comprises a plurality of horizontal cross-members 42 extending between the vertical members 40 at the left and right sides of the back. The frame 24 further comprises a plurality of diagonal cross-members 50 extending diagonally between the vertical members 40 at the left and right sides of the back. A door frame (not shown) may be mounted between adjacent horizontal cross-members 42, near the bottom of the hoistway 22, at what would be ground level when the unit 20 is installed on a building. This door frame defines an access opening in the back 30, providing access to the hoistway 22 from the outside of the building. The access opening is closed with a sliding door (or pair of sliding doors), similar to sliding door 48 closing the access openings 46 in the front of the unit. In many applications there may be no need for external access to the hoistway, and thus no access opening would will be provided in the back 30 of the hoistway 22.

Figure 3:
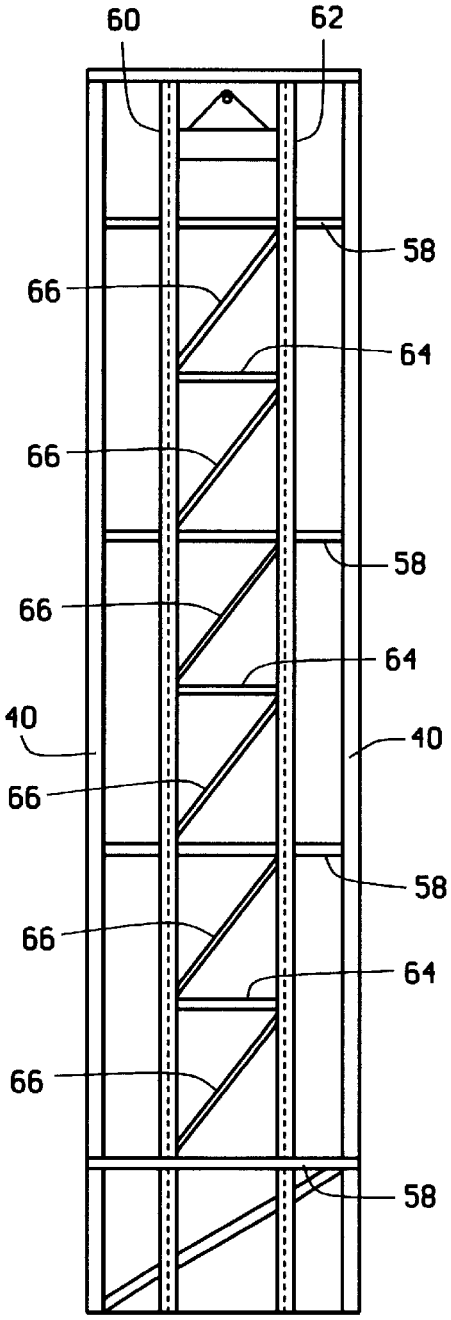
FIG. 3 is a right side elevation view of the preassembled elevator unit with the layers of the skin removed to reveal details of construction.

As shown in FIG. 3, at the sides 32 and 34 of the hoistway 22, the frame 24 comprises a plurality of horizontal cross-members 58, extending between the two vertical members 40. Two additional side supports 60 and 62 extend substantially the length of the hoistway 22 generally in the center of each side. A plurality of horizontal cross-members 64 extend between the side supports 60 and 62 and a plurality of diagonal cross-members 66 also extend between the side supports 60 and 62.

The hoistway 22 is preferably covered with a protective skin 26. (See FIG. 7) The skin preferably comprises a plurality of horizontal metal studs, covered by a layer of fiberglass insulation, a layer of plywood, and protective barrier of Tyvek® sheeting. Any conventional siding can be applied over the exterior of the hoistway 22 to make the unit blend in with the building. The hoistway 22 is preferably enclosed on at least three, and most preferably all four sides with the skin 26. A beam 70 extends transversely across the hoistway 22 between the left and right sides. (See FIG. 6).

Figure 4:
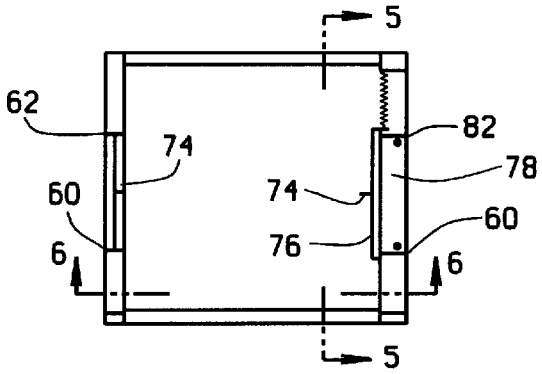
FIG. 4 is a top plan view of the preassembled elevator unit with the skin removed to reveal details of construction.

As shown in FIG. 4, a rail 74 extends vertically in the center of each side of the hoistway 22. The rail 74 has a generally T-shaped cross-section, and is oriented with the stem of the "T" extending generally inwardly, toward the center of the hoistway 22. On the left side 32 of the hoistway 22, the rail 74 is mounted on the cross-members 64 between the side supports 60 and 62. On the right side 34 of the hoistway 22, the rail is mounted on a plate 76 extending between the side supports 60 and 62, to define a space 78 for receiving the driving mechanism described below.

Figure 8:
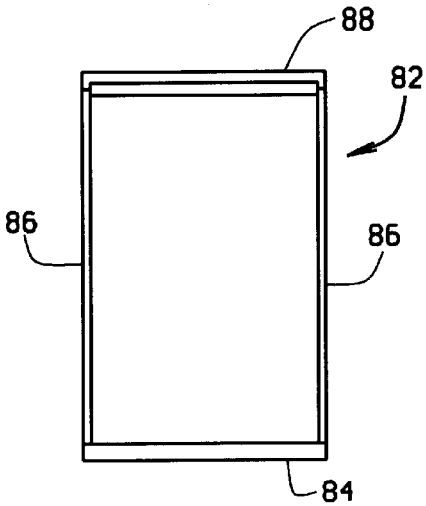
FIG. 8 is a front elevation view of the support cage for the elevator car.
Figure 9:
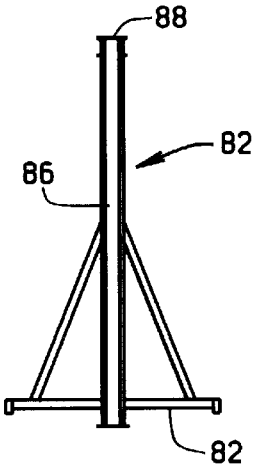
FIG. 9 is side elevation view of the support cage.
Figure 10:
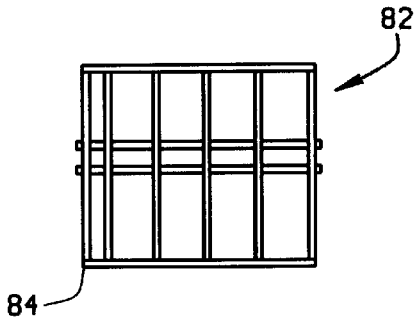
FIG. 10 is bottom plan view of the support cage.

The elevator car 80 (shown in FIG. 5) is mounted on a support cage 82 shown in FIGS. 8–10. The support cage 82 comprises a bottom 84 (FIG. 10) for supporting the elevator car 80, and left and right side members 86. A top member 88 extends between the side members 86, above the top of the elevator car 80. The elevator car -80 in the cage 82 is positioned between the vertically extending rails 74 on each side of the hoistway 22. The side members 86 of the support cage 82 engage the rails 74, restraining the cage 82 and thus the car 80 from lateral and front to back motion in the hoistway 22. The support cage 82 is suspended by a pair of cables 90.

The elevator car 80 is preferably of conventional construction, having an access opening 92 at the front that is closed by an elevator door 94. If the hoistway is provided with an access opening in the back 30, then the elevator car 80 also has an access opening (not shown) at the back, that is closed with a door (also not shown), similar to the access opening 92 and door 94 on the front of the elevator car 80. Safety devices well known in the art can be mounted on the top member 88, and connected to a monitoring device to stop the movement of the elevator car 80 if the car exceeds a predetermined maximum speed.

A first pair of pulleys 96 is mounted on the underside of the beam 70 so that the cables 90 are generally in the center of the hoistway 22. A second pair of pulleys 98 is mounted on the beam 70 generally at the right side of the hoistway 22. A third pair of pulleys 100 is mounted on the upper end of a vertical driver 102. (See FIG. 5) Each cable 90 extends upwardly from the top member 88 of support cage 82 over one of the first pair of pulleys 96, over one of the second pair of pulleys 98, downwardly around one of the third pair of pulleys 100, and back up to the beam 70, where the end of the cable is anchored. Thus movement of the third pulleys 100 caused by the movement of the driver 102, causes the support cage 82 and elevator car 80 to move upwardly and downwardly in the hoistway. Specifically, as the driver 102 raises the third pair of pulleys 100, the elevator car 80 moves downwardly in the hoistway, and as the driver lowers the third pair of pulleys 84, the elevator car 80 moves upwardly in the hoistway.

Figure 5:
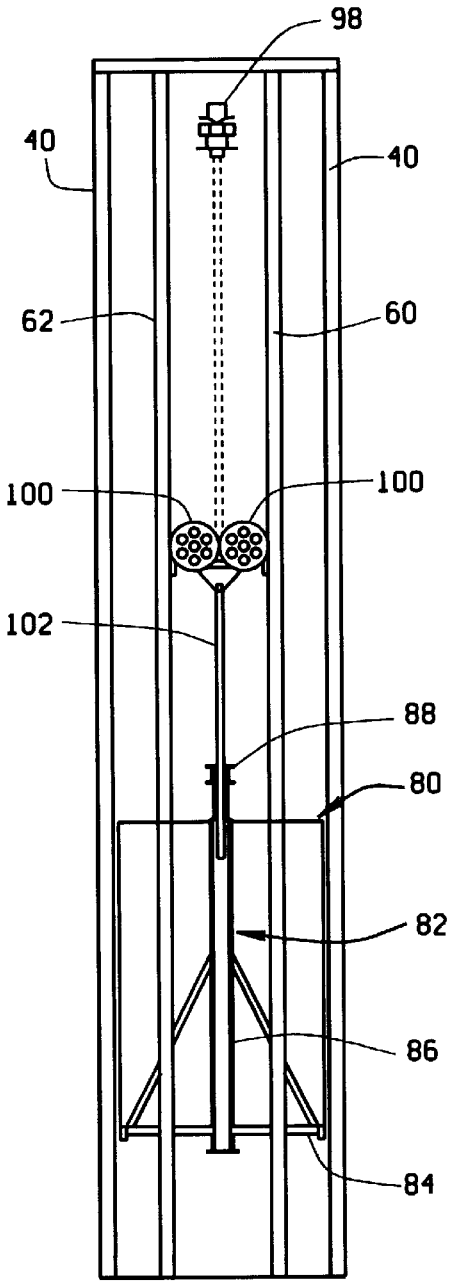
FIG. 5 is vertical cross sectional view of the preassembled elevator unit taken along the plane of line 5—5 in FIG. 4.
Figure 6:
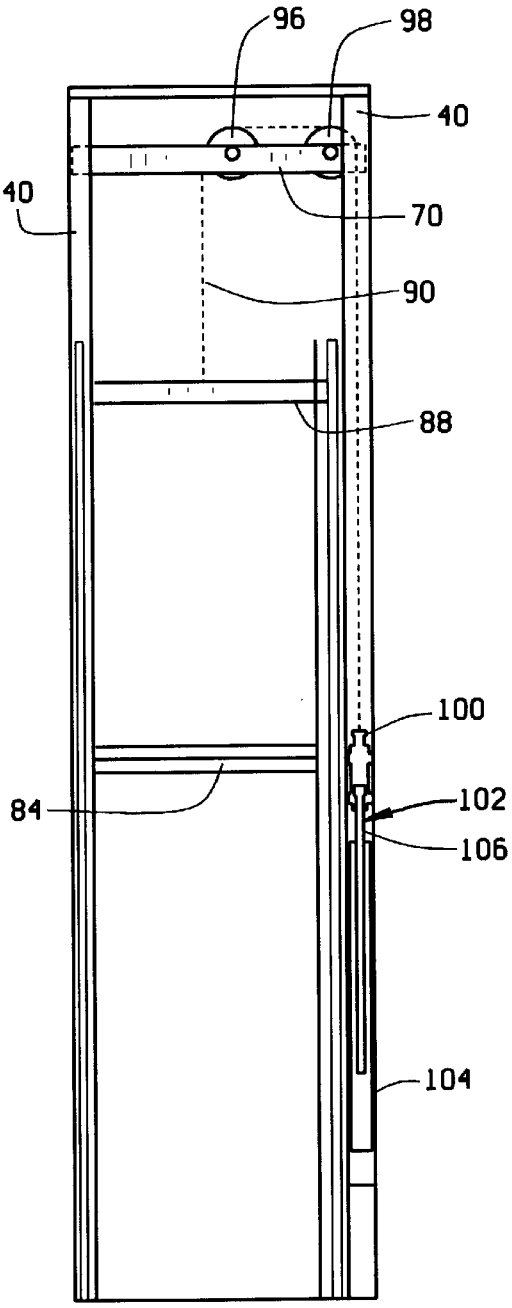
FIG. 6. is a vertical cross-sectional view of the preassembled elevator unit taken along the plane of line 6—6 in FIG. 4.

As shown in FIGS. 5 and 6, the driver 102 preferably comprises a hydraulic cylinder 104 attached to the hoistway, having a piston 106 on which third pair of pulleys 100 is mounted. Extending the piston 106 from the cylinder 104 raises the pulleys 100, and retracting the piston into the cylinder lowers the pulleys 100. The driver 102 can comprise some other means, such as a threaded rod, that is turned by a motor. The third pair of pulleys 100 would then be mounted on a block that is threadedly mounted on the rod, such that rotation of the rod caused by the motor causes the block, and thus the third pair of pulleys 100, to move upwardly and downwardly.

Heating ventilating and air conditioning equipment 116 (see FIG. 11A) can be provided in the top of the hoistway 22, avoiding dependence on the building's ventilation system, and eliminating the need to try to make connections to the building's ventilation system.

Figure 11A:
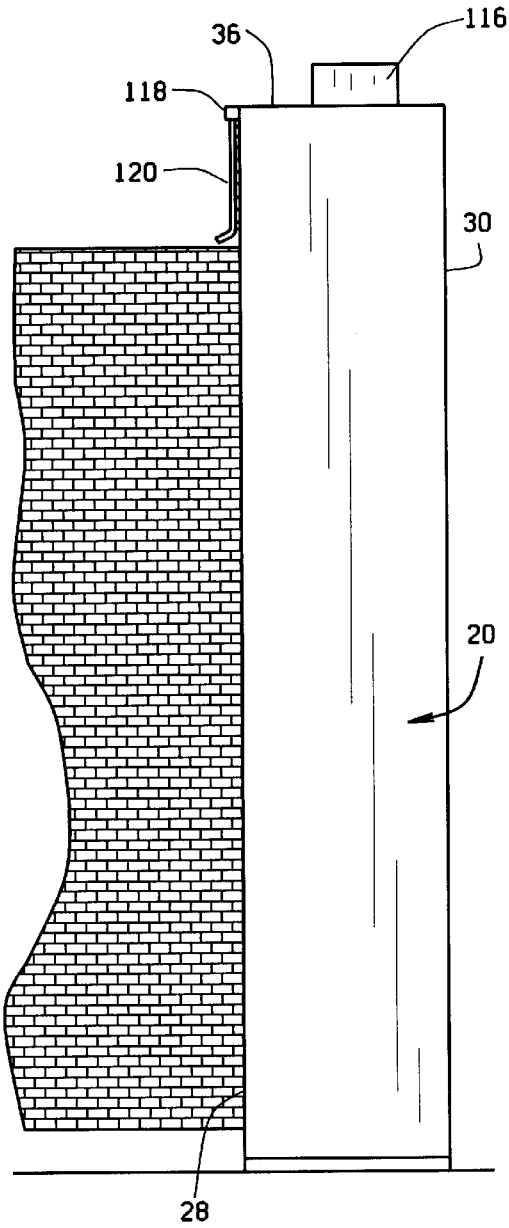
FIG. 11A is a side elevation view of a preassembled elevator unit shown as it would be installed on a preexisting building shorter than the unit.
Figure 11B:
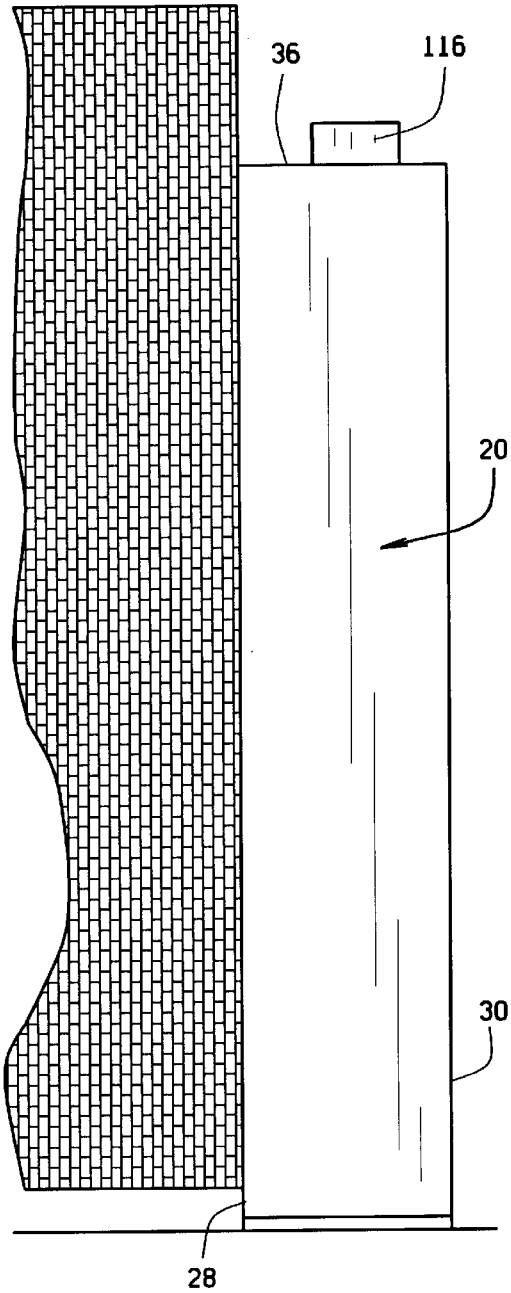
FIG. 11B is a side elevation view of a preassembled elevator unit shown as it would be installed on a preexisting building taller than the unit.
Figure 11C:
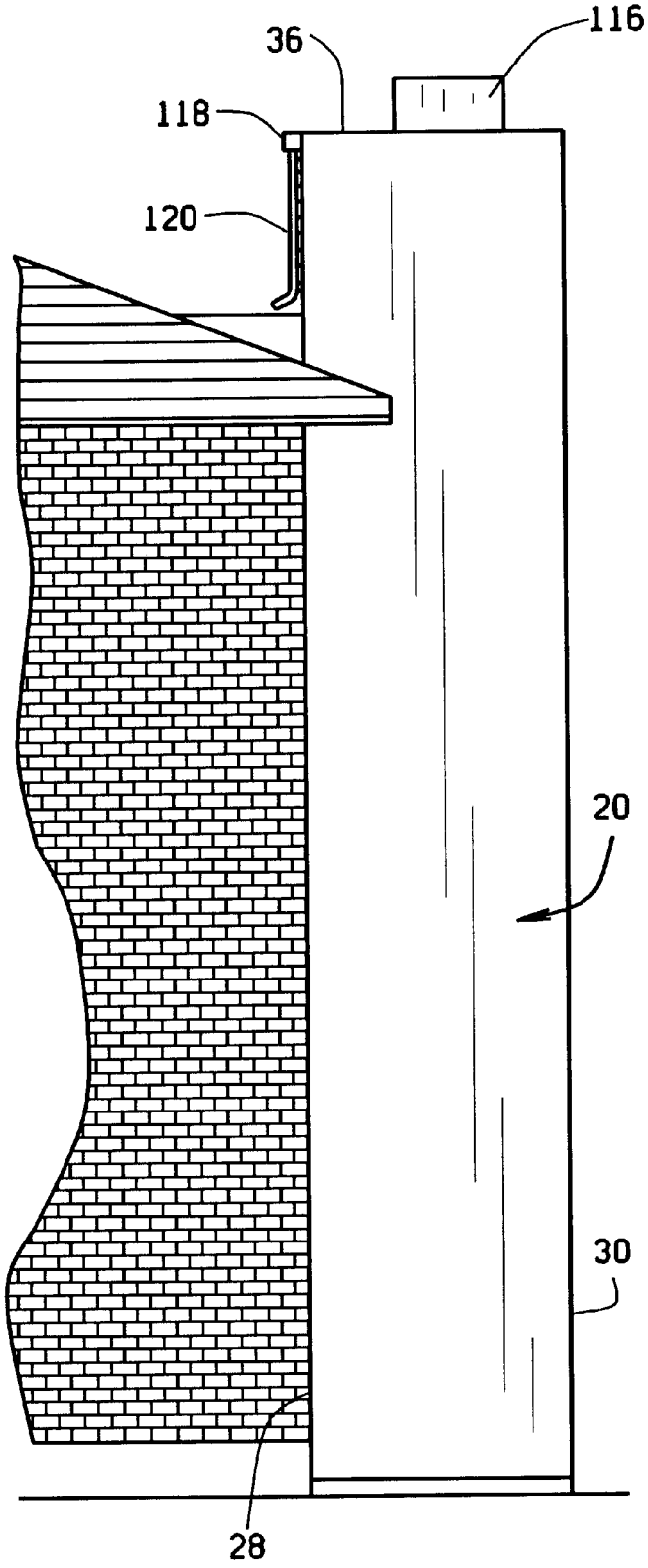
FIG. 11C is a side elevation view of a preassembled elevator unit shown as it would be installed on a preexisting building with an eave.
Figure 11D:
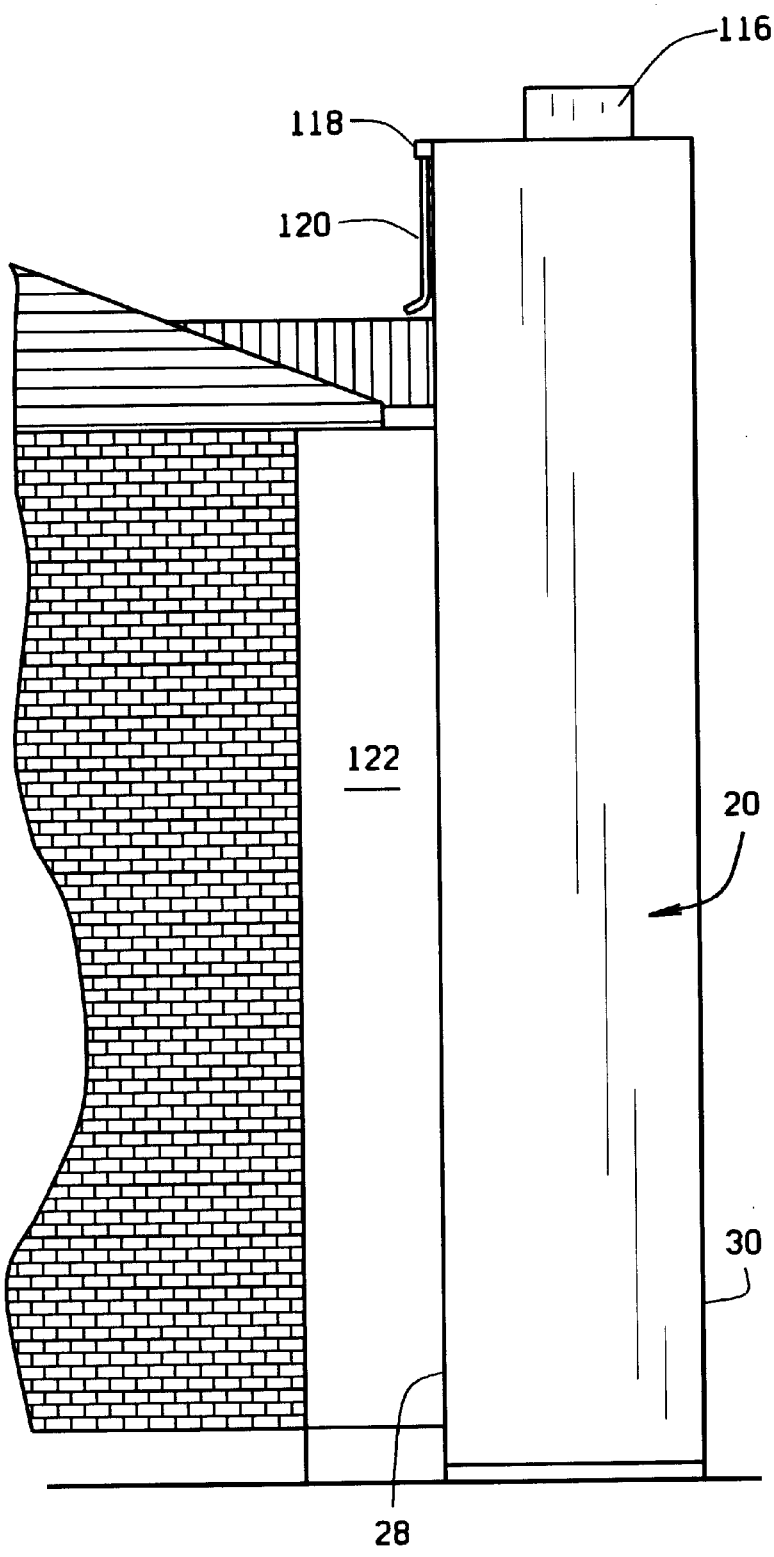
FIG. 11D is a side elevation view of a preassembled elevator unit shown as it would be installed on a preexisting building with a connecting extension.

The elevator unit 20 is thus completely self-contained, and is ready to mount to an existing building B, preferably on an exterior wall. FIG. 11A shows the preassembled elevator unit 20 as it would be installed on a building that is shorter than the unit. An optional roof gutter 118 and downspout 120 can be provided to help drain the roof of the unit. FIG. 11B shows the preassembled elevator unit shown as it would be installed on a preexisting building taller than the unit. FIG. 11C shows the preassembled elevator unit shown as it would be installed on a preexisting building with an eave E. A cutout is simply made in the eave E to accommodate the hoistway 22. FIG. 11D shows the preassembled elevator unit as it would be mounted on an existing building with a connecting extension 122 extending between the building and the hoistway, forming a hallway between the building and the unit 20.

Figure 12:
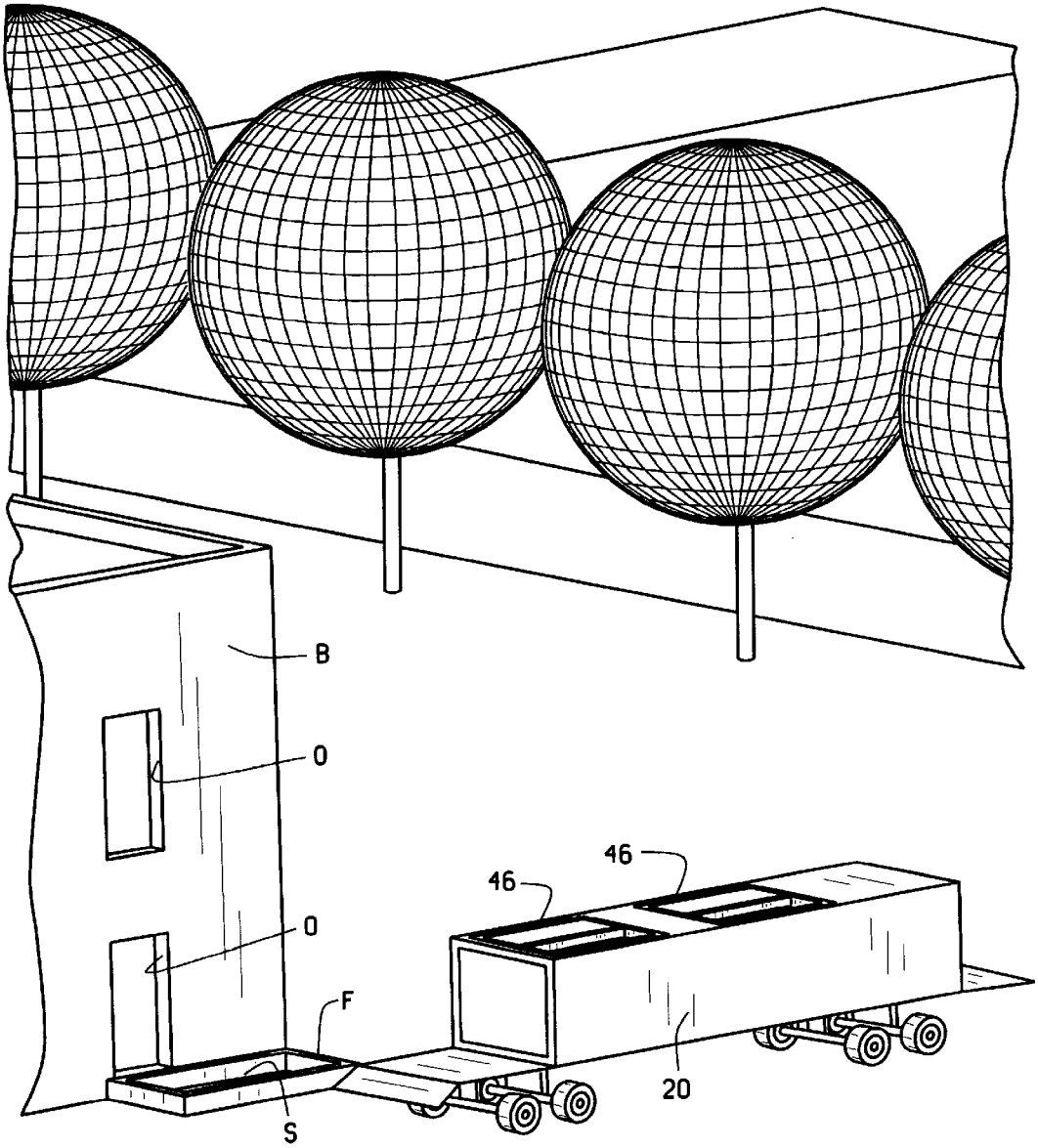
FIG. 12 is a perspective view illustrating the delivery of the preassembled elevator unit to an installation site.
Figure 13:
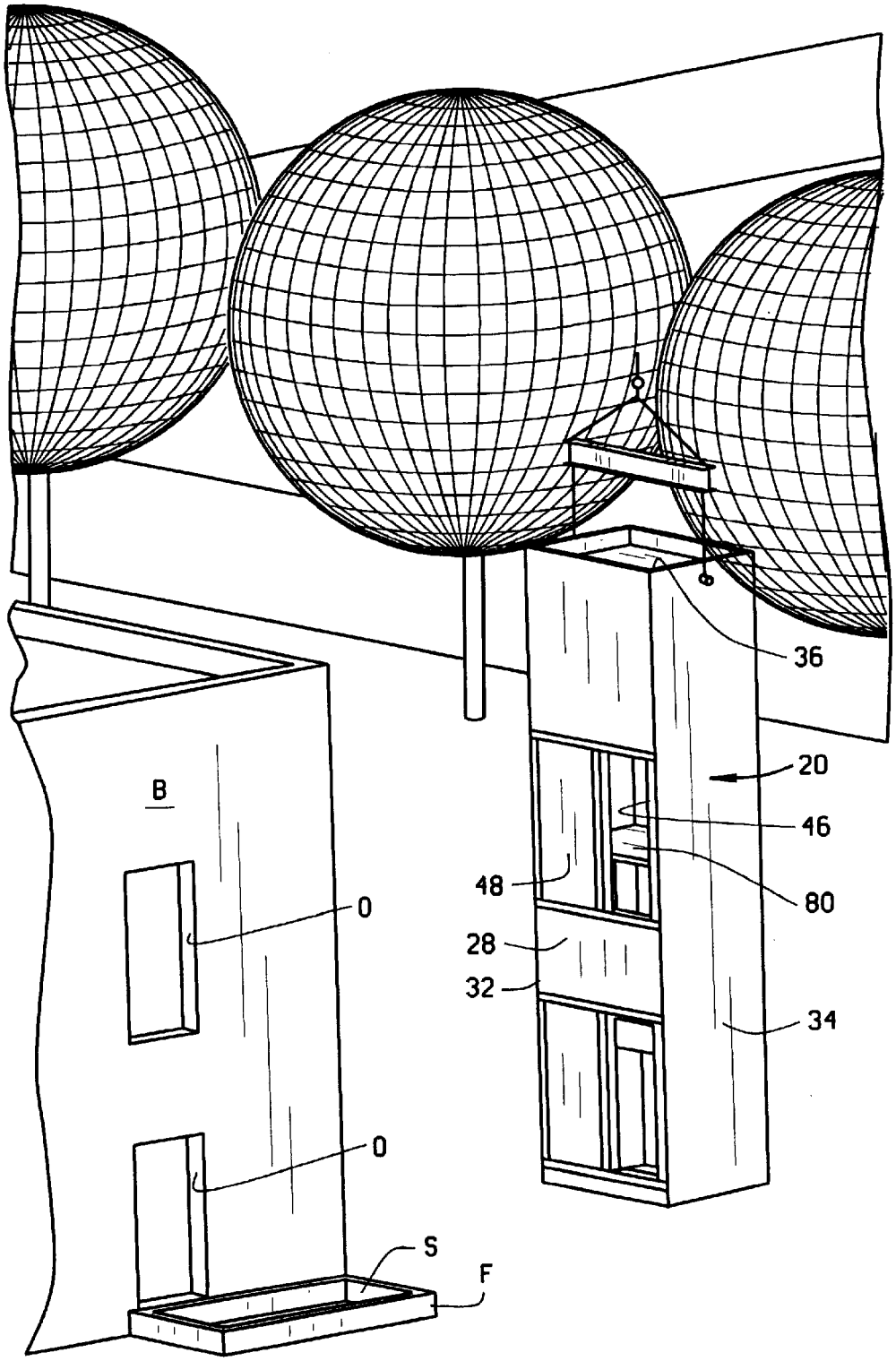
FIG. 13 is a perspective view illustrating the aligning of the preassembled elevator unit with the existing building.
Figure 14:
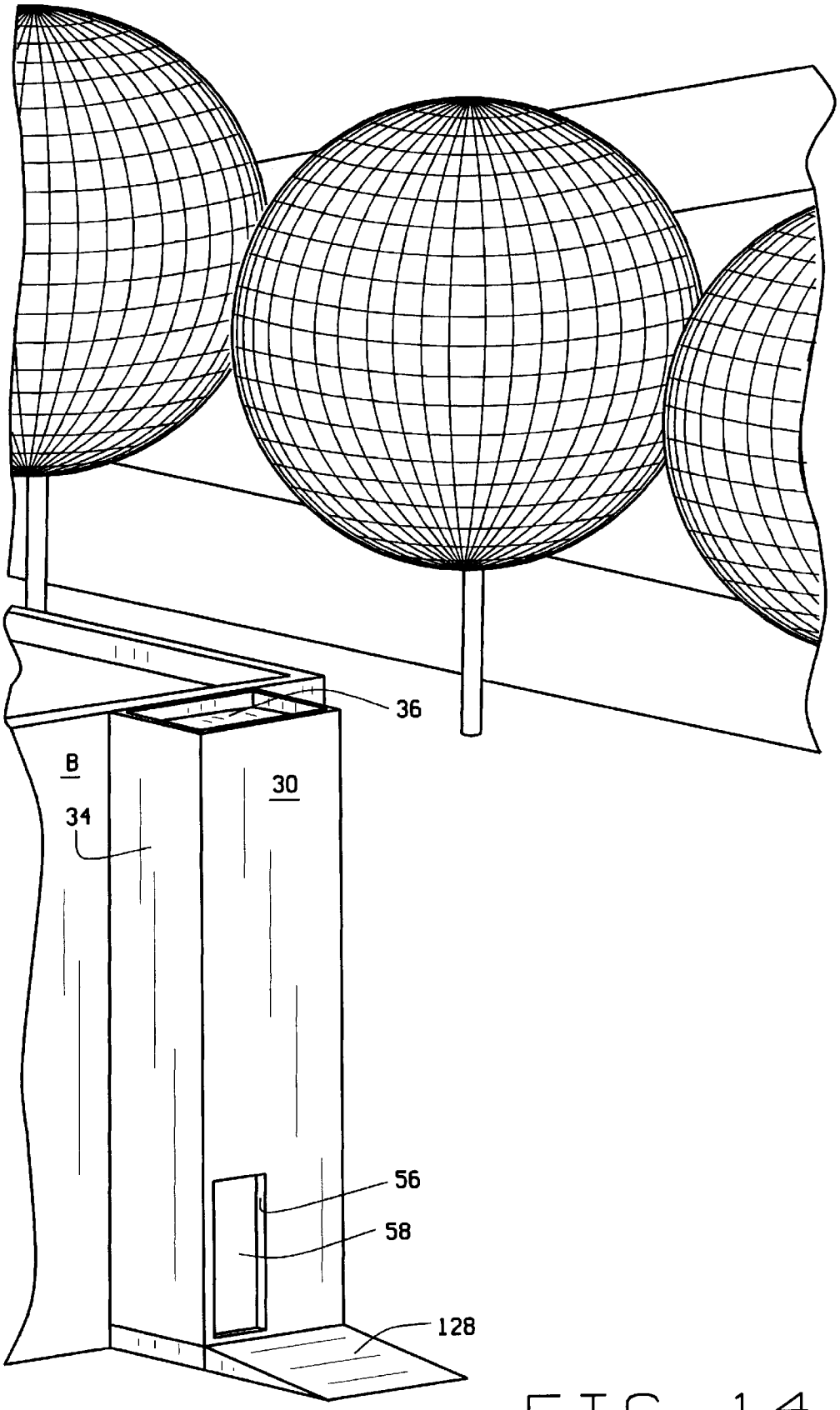
FIG. 14 is a perspective view illustrating the preassembled elevator unit after installation on the existing building.

As shown in FIGS. 12–14, according to the method of retro-fitting an elevator to an existing multilevel building of this invention, the preassembled elevator unit 20, comprising at least the hoistway enclosure containing an elevator car 80 and a drive mechanism for moving the car within the enclosure is provided at the site of the building B. A footing F is preferably constructed below where the unit 20 is to be installed. The footing helps to place the elevator unit at the proper height, and to provide a safety clearance space S below the hoistway. At least one elevator access opening O can be provided through the exterior of the building B. If the elevator is to service more than one floor of the building, then an opening O is made at each floor where there is to be elevator service. These openings O are vertically aligned. The openings O can usually be conveniently made where there were existing windows in the building B.

The elevator unit 20 is then positioned against the exterior of the building B, for example with a crane (not shown), with the access openings 46 of the unit 20 aligned with the access openings O in the building. Once the unit 20 is properly positioned, the unit is secured to the exterior of the building B. Elevator calling controls and elevator directional signals can be installed in the building B and connected to pre-wired connectors on the unit 20. If the hoistway has an external access opening 56, a suitable ramp 128 can be constructed to provide access to the access opening 56.

Thus, the elevator unit 20 provides convenient floor to floor access within the building, and can also provide convenient access to the interior of the building from the exterior. The method requires only minimal preparation at the site, and the installation process is relatively quick so that the building can be promptly made accessible to persons with handicaps, with a minimum of disruption to the existing functions of the building. No significant floor space is lost inside the building, nor is the structural integrity of the building compromised by cutting a hoistway through the floors.

What is claimed is:

1. A method of retrofitting an elevator to an existing building, the method comprising the steps of:

manufacturing a preassembled elevator unit comprising a hoistway having a front, a back, a left side, a right side, a floor and a roof, the hoistway having at least two vertically aligned elevator access openings therethrough, the hoistway enclosing an elevator car and a drive mechanism for moving the car within the hoistway, whereby the hoistway, the car and the drive mechanism are manufactured together as one complete unit at a manufacturing site remote from the building, the hoistway configured to be secured to the exterior of the building;

transporting the preassembled elevator unit from the manufacturing site to the building;

forming a plurality of vertically aligned elevator access openings through the exterior of the building, correspondingly spaced with the vertically aligned elevator access openings through the hoistway;

positioning the preassembled elevator unit against the exterior of the building with the elevator access openings through the hoistway in alignment with the elevator access openings in the exterior of the building; and securing the hoistway to the exterior of the building.

2. A method in accordance with claim 1 further comprising the steps of:

providing electrical connectors on the preassembled elevator unit; and providing elevator calling controls for installation in the building.

3. A method in accordance with claim 2 further comprising the steps of:

installing the elevator calling controls in the building; and connecting the electrical calling controls to the electrical connectors on the preassembled elevator unit.

4. A method in accordance with claim 1 wherein manufacturing a preassembled elevator unit comprises the step of manufacturing the preassembled elevator unit with a ventilation system coupled to the hoistway.

5. A method in accordance with claim 4 wherein manufacturing the preassembled elevator unit with a ventilation system coupled to the hoistway comprises manufacturing the preassembled elevator unit with heating, ventilation and air conditioning equipment coupled to the hoistway.

6. A method of retrofitting an elevator to an existing building, the method comprising the steps of:

manufacturing a preassembled elevator unit comprising a hoistway having a front, a back, a left side, a right side, a floor and a roof, the hoistway having at least two vertically aligned elevator access openings therethrough, the hoistway enclosing an elevator car and a drive mechanism for moving the car within the hoistway, whereby the hoistway, the car and the drive mechanism are manufactured together as one complete unit at a manufacturing site remote from the building, the hoistway configured to be secured to the building;

transporting the preassembled elevator unit from the manufacturing site to the building;

forming a plurality of vertically aligned building elevator access openings through a wall of the building, said building elevator access openings correspondingly spaced with the elevator access openings through the hoistway;

positioning the preassembled elevator unit with the elevator access openings through the hoistway in alignment with the building elevator access openings; and securing the hoistway to the building.

* * * * *